US005113639A

United States Patent [19]

Bryson

[11] Patent Number: 5,113,639

[45] Date of Patent: May 19, 1992

[54] SELECTIVE ARTICLE WRAPPING

[75] Inventor: Robert A. Bryson, Huber Heights, Ohio

[73] Assignee: AM International Incorporated, Chicago, Ill.

[21] Appl. No.: 657,680

[22] Filed: Feb. 19, 1991

[51] Int. Cl.[5] ..... B65B 11/48

[52] U.S. Cl. ..... 53/466; 53/168; 53/202; 53/461; 53/553

[58] Field of Search ..... 53/466, 461, 450, 202, 53/229, 231, 230, 553, 168, 548, 545

[56] References Cited

U.S. PATENT DOCUMENTS

| | | | |
|---|---|---|---|
| 2,332,316 | 10/1943 | Hexter et al. | 53/202 X |
| 2,369,753 | 2/1945 | Papendick | 53/202 X |
| 3,559,367 | 2/1971 | Misik | 53/553 X |
| 4,499,706 | 2/1985 | Scheller | 53/466 X |
| 4,827,698 | 5/1989 | Banks | 53/461 X |
| 4,858,416 | 8/1989 | Monaghan | 53/553 X |

*Primary Examiner*—James F. Coan
*Attorney, Agent, or Firm*—Tarolli, Sundheim & Covell

[57] ABSTRACT

A method and apparatus for wrapping selected articles of a plurality of articles. A stream of the articles is moved along a first path by a first conveyor. Selected articles are sequentially moved from the stream of articles moving along the first path to a second conveyor by a deflector. Moving the selected articles from the stream of articles results in the forming of gaps in the stream of articles at locations where the selected articles are sequentially moved from the stream of articles. The gaps in the stream of articles are maintained as the stream of articles moves along the first path. Disposed along the second path is a wrapping station where selected articles are sequentially wrapped. As one of the selected articles is moved through the wrapping station, a pair of webs engage opposite sides of the one article and are sealed to wrap the one article. The seal is severed along its center portion and adjacent to a trailing end of the one article. The next selected article engages the remaining portion of the severed seal and pulls the webs forward to enclose the next article as it is moved along the second path. The second conveyor moves the wrapped articles back to the gaps maintained within the stream of articles moving along the first path by the first conveyor.

44 Claims, 10 Drawing Sheets

SELECTIVE ARTICLE WRAPPING

BACKGROUND OF THE INVENTION

The present invention relates to a method and apparatus for wrapping selected sheet material articles of a plurality of the articles.

During the processing of magazines, newspapers, or other sheet material articles, it may be desirable to wrap selected articles. There are many different reasons for wanting to wrap selected magazines from a series of magazines. For example, it may be desirable to wrap specific magazines containing high quality advertisements for readers who are target advertisement recipients to provide an improved appearance. It may be desired to wrap magazines to enclose loose items, such as billing statements, addressing cards or advertisement flyers.

During the wrapping of each selected magazine it is desirable to have the wrapping material tightly and neatly wrapped around the magazine. The wrapping material may be sealed to keep the wrapping material in place and to keep dirt out of the wrapped magazine. It is also desirable that sequential ordering of the magazines prior to wrapping be maintained, even though certain magazines may be wrapped, to ensure proper delivery routing of the magazines to readers.

SUMMARY OF THE INVENTION

The present invention provides an apparatus for wrapping selected articles of a plurality of articles. The plurality of articles are continuously moved in a stream by a first conveyor. A deflector is provided to sequentially move selected articles from the stream to a second conveyor. A gap is formed in the stream of articles at a location where a selected article is moved from the stream of articles.

The second conveyor sequentially moves the selected articles to a wrapping station At the wrapping station, the selected articles are sequentially wrapped and sealed. The wrapping material is severed at a seal to divide the seal into a first portion which is connected with the wrapping material which wraps a first selected article and a second portion which is connected with additional wrapping material.

A leading edge portion of the next selected article to be wrapped is moved into engagement with the additional wrapping material adjacent to the second portion of the seal. After each selected article is wrapped, the wrapped article is moved into the gap in the stream of articles which was formed when the selected article was moved from the stream of articles for wrapping.

BRIEF DESCRIPTION OF THE DRAWINGS

The foregoing and other objects and features of the present invention will become more apparent to one skilled in the art upon consideration of the following description and the accompanying drawings, in which.

DESCRIPTION OF THE PREFERRED EMBODIMENT OF THE INVENTION

General Description

Figure 1:
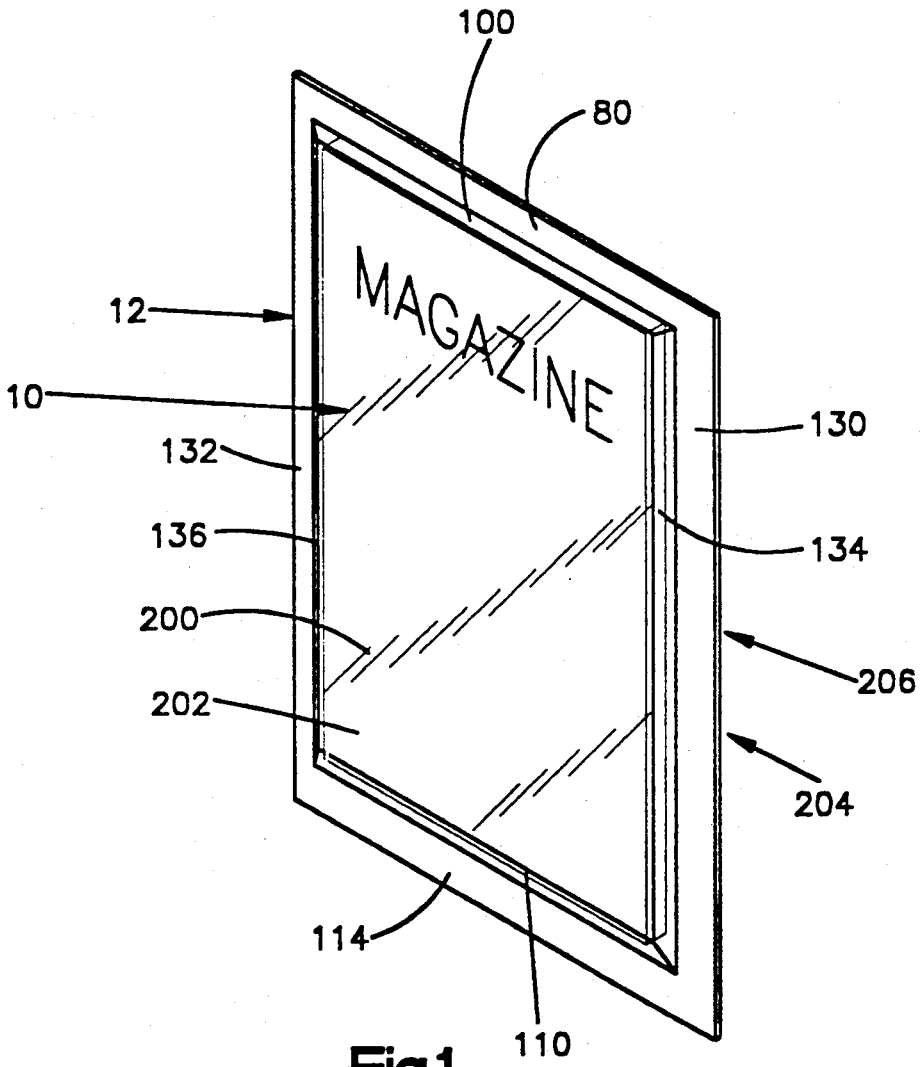
FIG. 1 is a pictorial illustration of an article that has been wrapped in accordance with the method and apparatus of the present invention.

A selected article 10 wrapped according to the method of the present invention is shown in FIG. 1. The selected article is a sheet material article and is shown as being a magazine. A portion 12 of wrapping material covers the selected article 10. The portion of wrapping material 12 which covers the selected article 10 provides such benefit as improved appearance, enclosure of loose items, and protection of the selected article 10.

Figure 2:
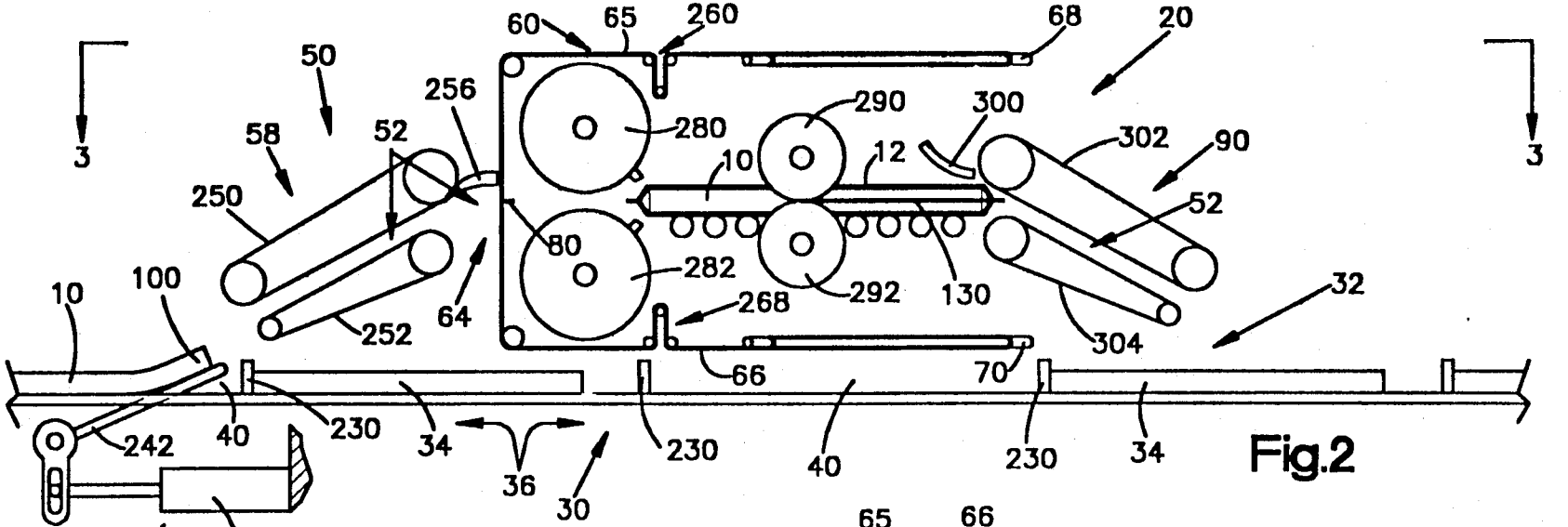
FIG. 2 is a schematic illustration of an apparatus constructed and operated in accordance with the present invention, several articles are illustrated in various stages of progression through the apparatus.

An apparatus 20 for wrapping selected articles 10 is shown in FIG. 2. The apparatus 20 includes a first conveyor 30 which continuously moves a stream 32 of articles 34 along a supply path 36.

A deflector 38 is disposed adjacent the first conveyor 30. The deflector 38 is operable to deflect the selected article 10 from the stream 32 of articles 34 moving along the supply path 36. The deflection of the selected article 10 from the stream 32 of articles 34 forms a gap 40 in the stream 32.

The selected article 10 deflected from the stream 32 of articles 34 is moved into a continuously moving second conveyor 50 disposed along a wrapping path 52. A feed section 58 of the second conveyor 50 moves the selected article 10 along the wrapping path 52 toward a wrapping station 60. Disposed at the wrapping station 60 is heat sealable and transparent polymeric wrapping material 64 for wrapping the selected article 10.

Figure 3:
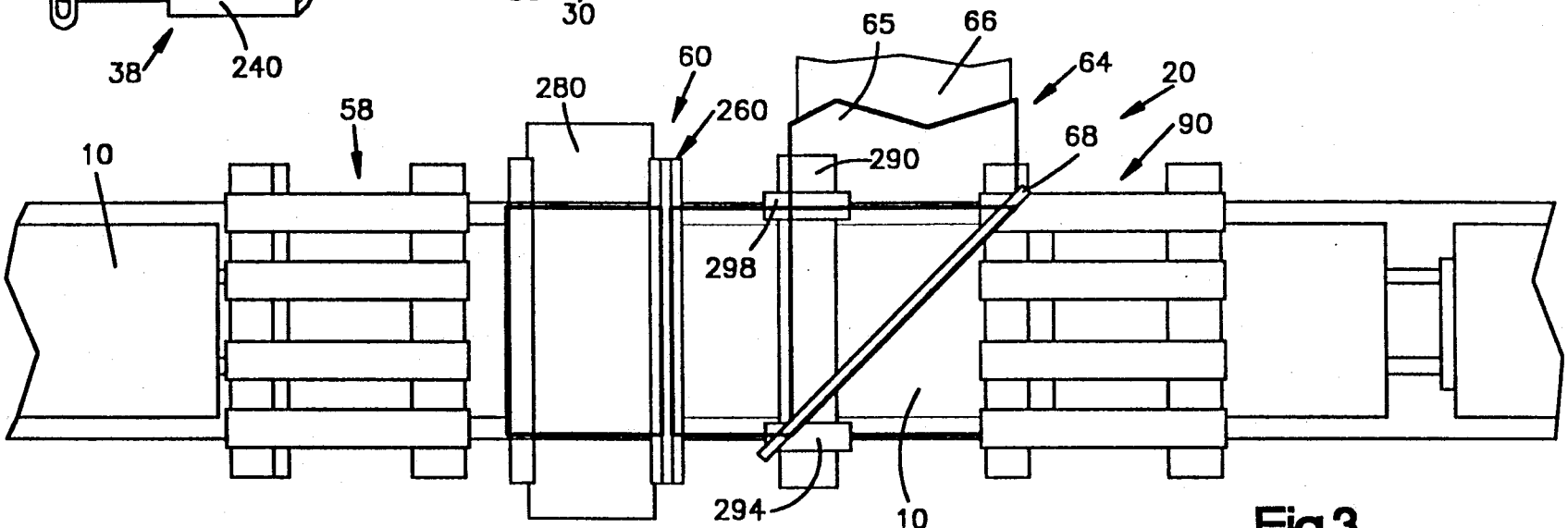
FIG. 3 is a plan view, taken along line 3—3 of FIG. 2, further illustrating the apparatus.

The wrapping material 64 includes a pair of webs 65 and 66 which extend from first and second sources of web material to the wrapping station 60 (FIGS. 2 and 3). The first and second sources of web material provide a continuous supply of transparent polymeric wrapping material 64. A the wrapping station 60 the wrapping material 64 is positioned by angle bars 68 and 70.

The two webs 65 and 66 are interconnected by a portion 80 of a seal (FIG. 2) that was previously formed in the wrapping material 64. The portion 80 of a seal is positioned at the wrapping station 60 to be proximate the feed section 58. Therefore, the wrapping material 64 adjacent to the portion 80 of a seal is engaged by a leading end of a selected article 10 to be wrapped. Engagement of the wrapping material 64 by the selected article 10 moves the wrapping material along the wrapping path 52. As the selected article 10 is moved along the wrapping path 52, the selected article 10 is wrapped and sealed.

After the selected article 10 is wrapped and sealed in a fluid tight transparent package, the selected article 10 is moved toward a discharge section 90 (FIG. 2) of the second conveyor 50. The discharge section 90 of the second conveyor 50 moves the wrapped selected article 10 back toward the stream 32 of articles 34. The wrapped selected article 10 is moved into the gap 40 in the stream 32 of articles 34 created when the selected article 10 was moved from the stream 32 by the deflector 38.

Wrapping and Sealing

Figure 4:
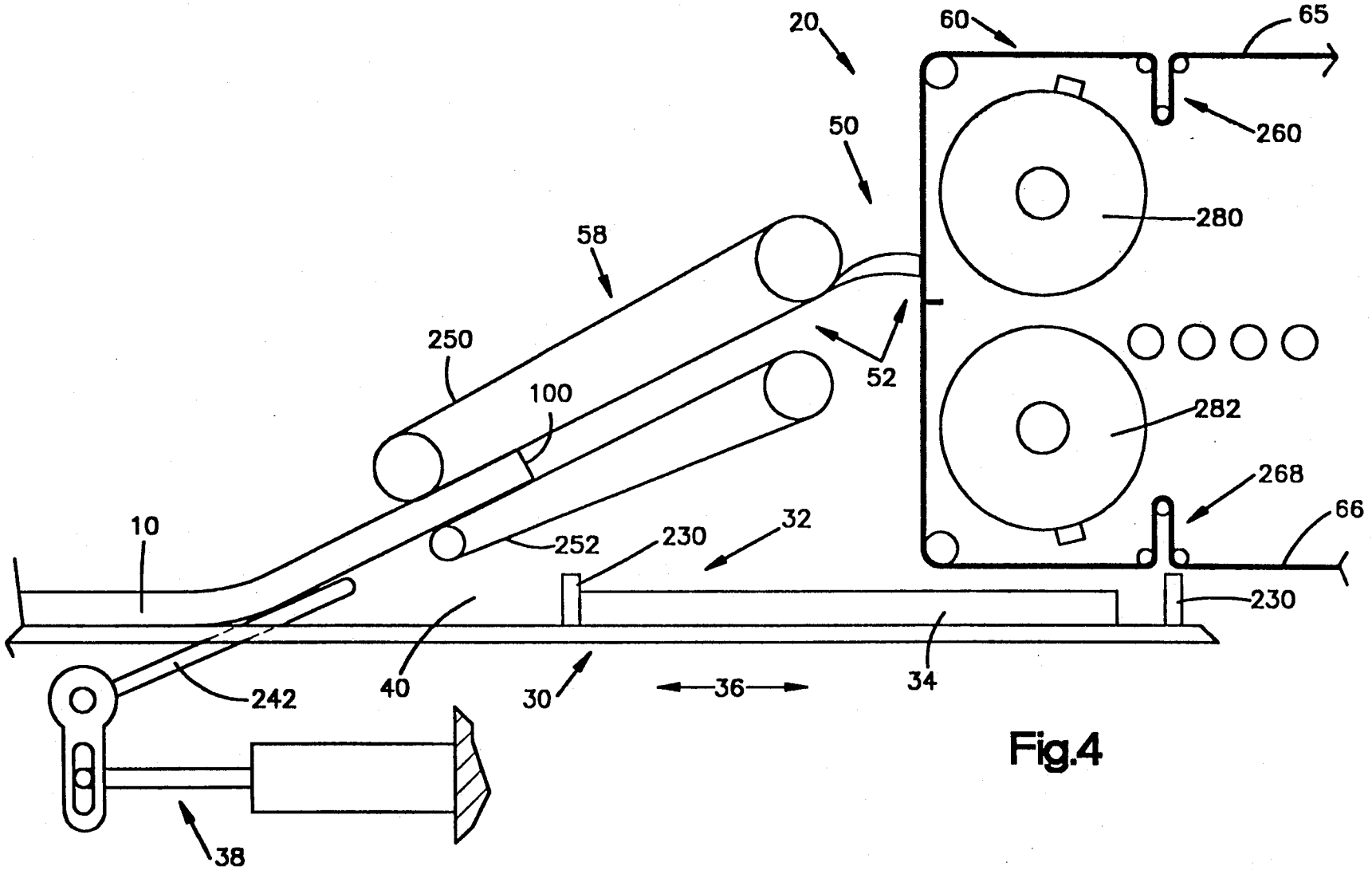
FIG. 4 is an enlarged schematic illustration of a portion of the apparatus of FIG. 2 and illustrating the manner in which a selected magazine or other sheet material article is moved from a stream of articles being transported by a first conveyor to a second conveyor.

The selected article 10 is removed from the stream 32 of articles 34 (FIG. 4) by the deflector 38 and feed section 58 of the second conveyor 50. The removal of the selected article 10 from the stream 32 of articles 34 creates the gap 40. The deflector 38 raises a leading end 100 of the selected article 10 to the inlet for the feed section 58 of the second conveyor 50. The feed section 58 is continuously operated at a higher speed than the first conveyor 30. Therefore, the feed section 58 accelerates the selected article 10 and moves the selected article 10 upwardly away from the stream 32 of articles 34.

Figure 5:
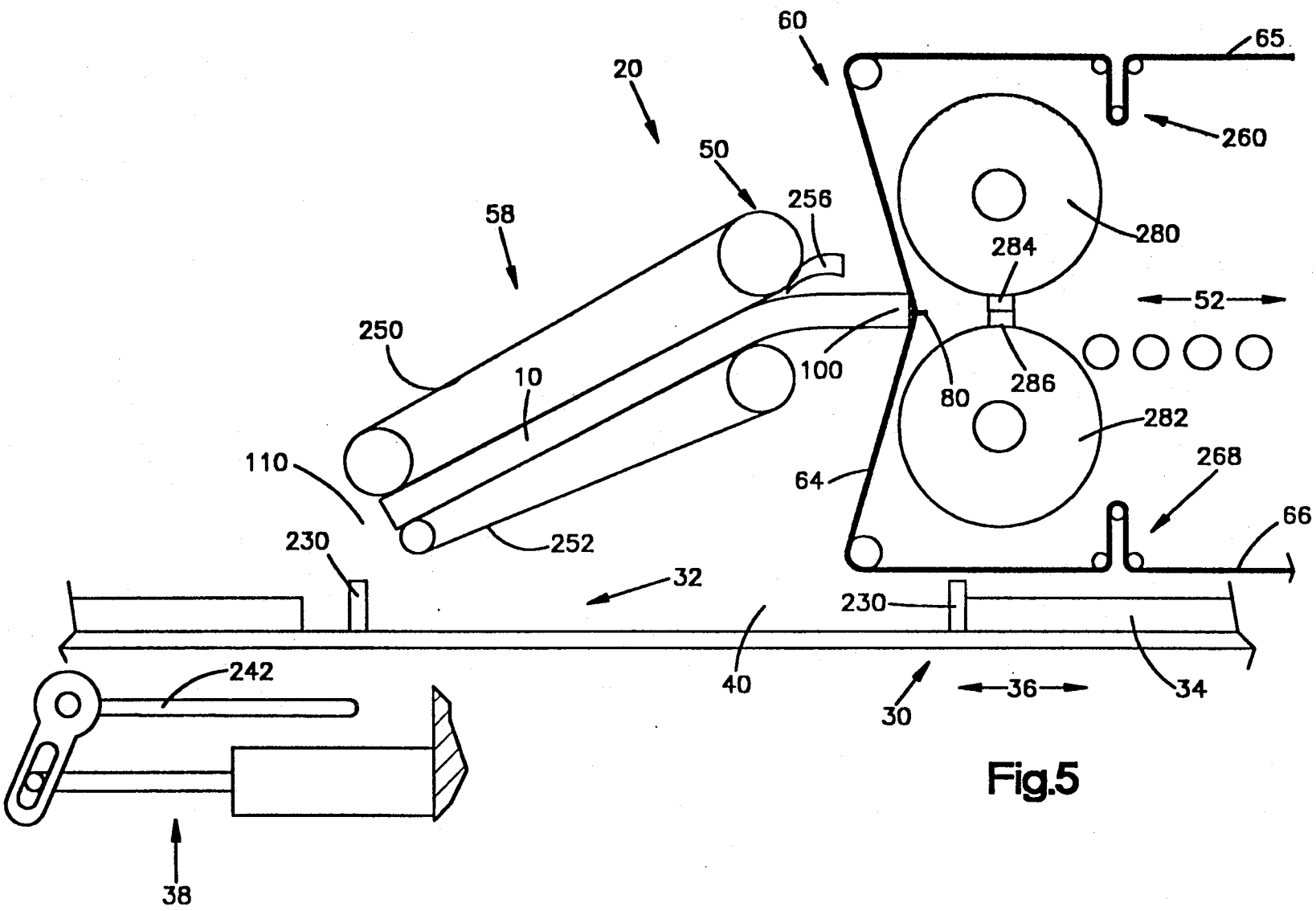
FIG. 5 is a schematic illustration, generally similar to FIG. 4, depicting the manner in which a leading end portion of the selected article engages a pair of webs of wrapping material adjacent an interconnecting seal.

As the selected article 10 is being moved forwardly by the feed section 58, the leading end portion 100 of the selected article 10 moves into engagement with the wrapping material 64 (FIG. 5). The wrapping material 64 is engaged by the leading end 100 adjacent to the portion 80 of seal previously formed in the wrapping material 64. As this is occurring, the gap 40 is maintained in the stream 32 of articles 34 moving along the supply path 36.

Force continues to be applied to the selected article 10 (FIG. 6) by the feed section 58 to move the selected article 10 along the wrapping path 52. The leading end 100 of the selected article 10 is pressed against the wrapping material 64 by the feed section 58. The wrapping material 64 is moved forward by movement of the leading end 100 of the selected article 10 along the wrapping path 52.

As the selected article 10 (FIG. 7) is moved along the wrapping path 52, the two webs 65 and 66 of the wrapping material 64 cover the selected article 10. A seal 112 (FIG. 8) is formed in the wrapping material 64 adjacent a trailing end 110 of the selected article 10. A portion 114 of the seal 112 remains connected to the portion 12 of wrapping material 64 which covers the selected article 10. The other portion 80 of the seal 112 is retained on the wrapping material 64 to interconnect the two webs 65 and 66. The portion 80 of the seal 112 interconnecting the two webs 65 and 66 is positioned along the wrapping path 52 to be engaged by a subsequent selected article 10.

Seals 130 and 132 (FIG. 1) are formed in the portion 12 of the wrapping material 64 which covers the selected article. The seals 130 and 132 formed in the portion 12 of the wrapping material 64 extend along side edge portions 134 and 136 of the selected article 10. The seals 130 and 132 extend to intersect the portions 80 and 114 of the seal 112 adjacent to the leading and trailing ends 100 and 110 of the selected article 10.

Figure 9:
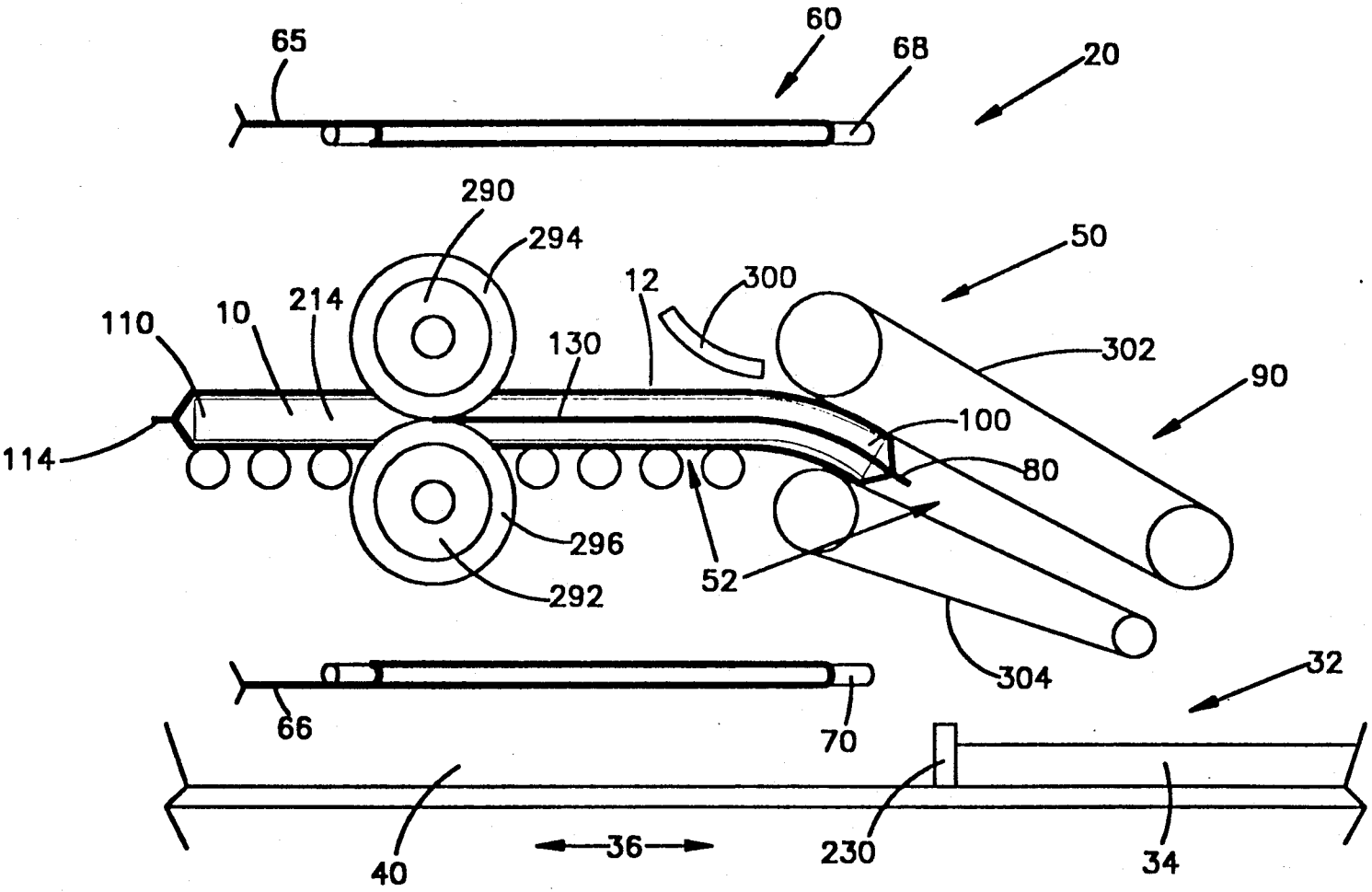
FIG. 9 is an enlarged schematic illustration of another portion of the apparatus of FIG. 2 and illustrating the manner in which a pair of rotary side sealers form seals adjacent to opposite edge portions of the selected magazine.

The seal 130 is formed as the selected article moves along wrapping path (FIG. 9). Simultaneously, as the seal 130 is formed, the seal 132 (not shown in FIG. 9) is also formed. The seals 130 and 132 extend parallel to the direction of travel of the selected article 10 along the wrapping path 52.

Figure 10:
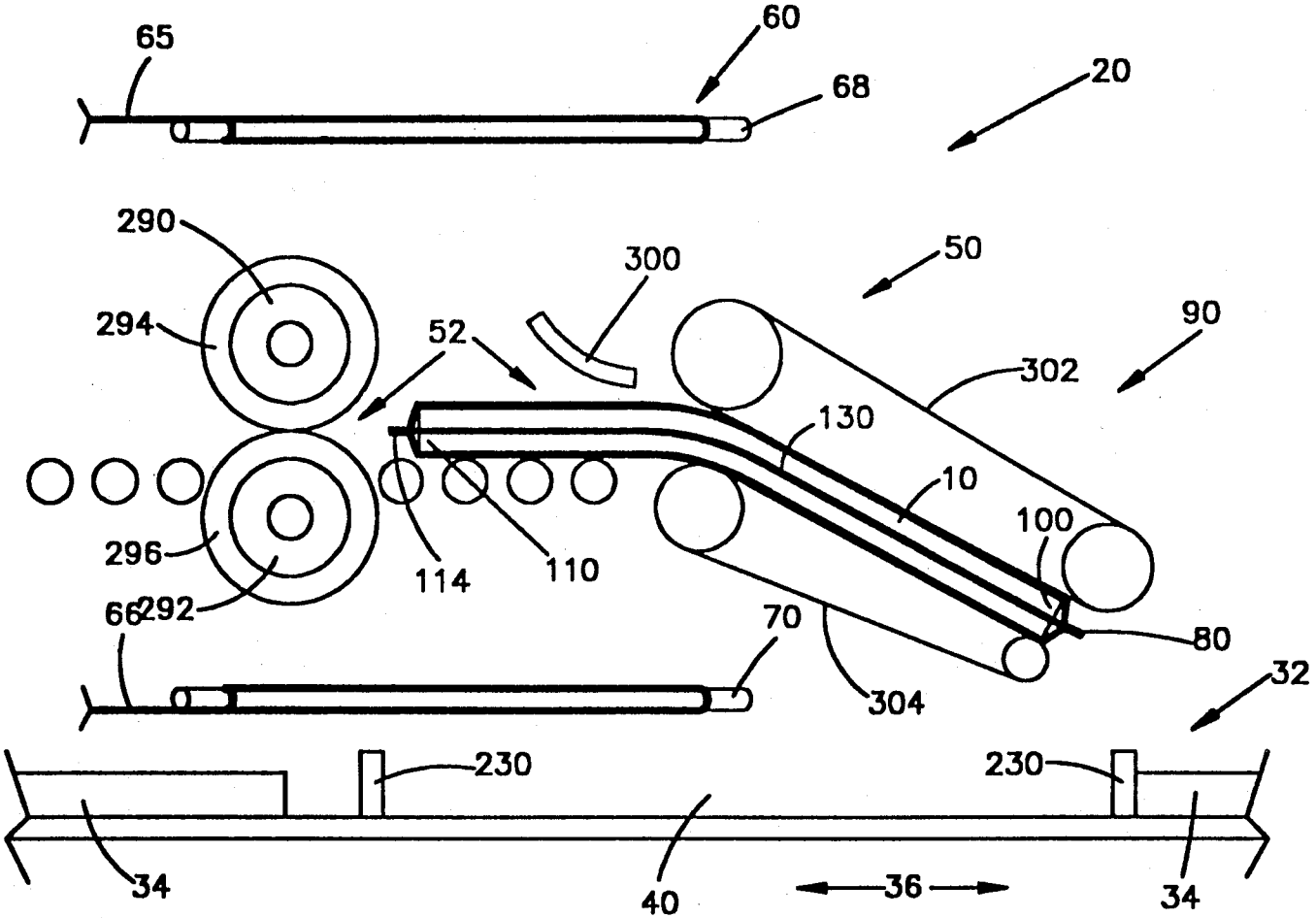
FIG. 10 is a schematic illustration, generally similar to FIG. 9, depicting the manner in which a wrapped magazine is moved toward a gap in a stream of articles being conveyed by the first conveyor.
Figure 11:
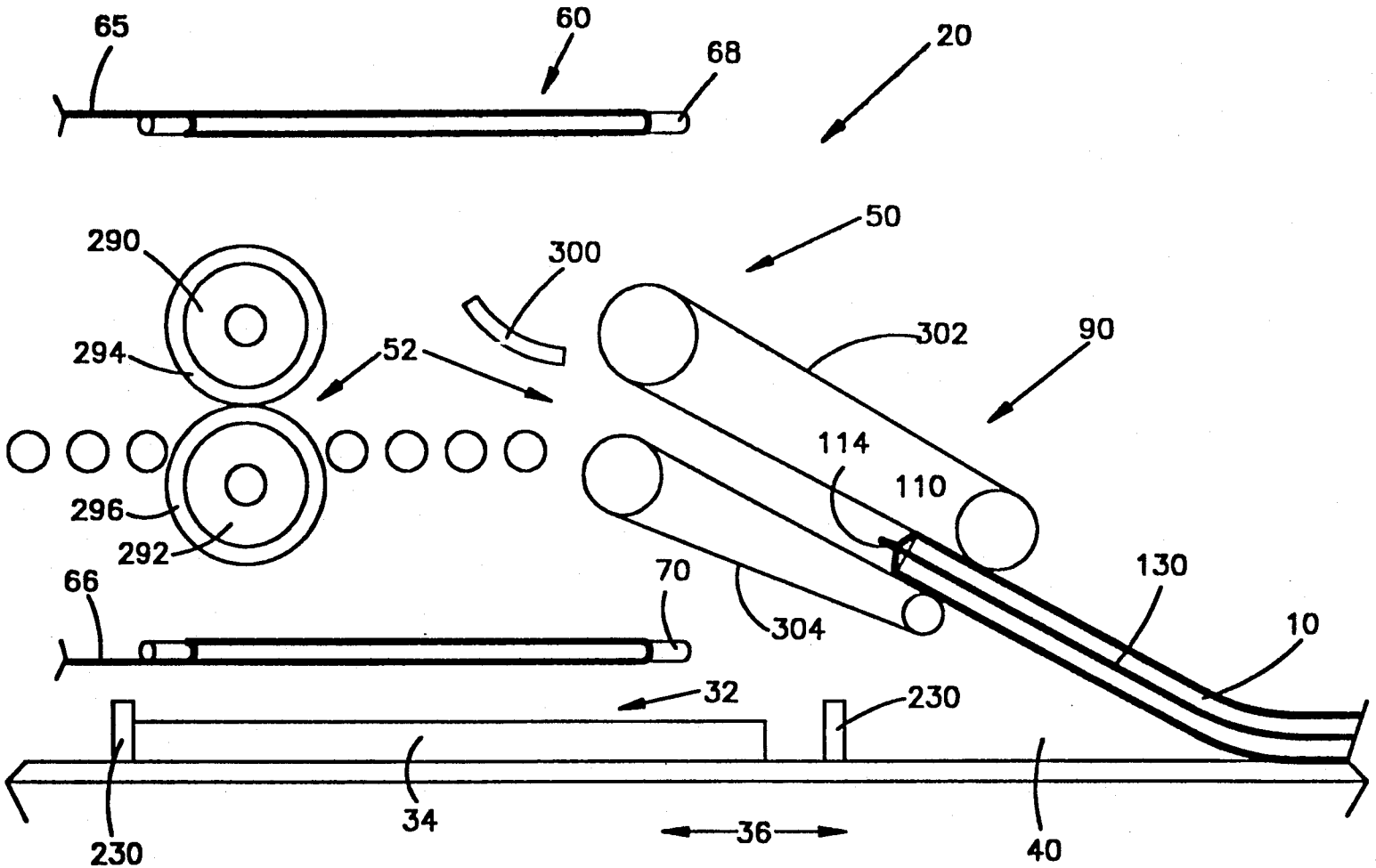
FIG. 11 is a schematic illustration, generally similar to FIGS. 9 and 10, illustrating the manner in which a magazine is deposited in a stream of magazines being transported by the first conveyor.

As the wrapping of the selected article 10 is completed, the selected article 10 is moved along the wrapping path 52 toward the discharge section 90 of the second conveyor 50. The discharge section 90 (FIG. 10) of the second conveyor 50 moves the wrapped selected article 10 along the wrapping path 52 toward the stream 32 of articles 34 being moved along the supply path 36. The discharge section 90 moves the wrapped selected article 10 from the wrapping path 52 back to the stream 32 of articles 34 moving along the supply path 34. The wrapped selected article 10 (FIG. 11) is moved into the gap 40 in the stream 32 of articles 34. The gap 40 having been created in the stream 32 of articles 34 by the movement of the selected article 10 from the stream 32.

Wrapped Articles

The selected article 10 wrapped in a transparent fluid tight container in accordance with the method of the present invention is illustrated in FIG. 1. The portion 12 of wrapping material 64 which covers the selected article 10 includes a portion 200 of the first web 65 of wrapping material 64. The portion 200 of wrapping material 64 covers an upper side 202 of the selected article 10. A portion 204 of the second web 66 of wrapping material 64 covers a lower side 206 of the selected article 10.

The portions 200 and 204 of wrapping material are joined together at the remaining portion 80 of the seal 112 (FIG. 8) formed at the trailing end of a preceding selected article 10. The remaining portion 80 of the seal 112 is disposed adjacent to the leading end 100 of the selected article 10 (FIG. 1). The portion 80 of seal 112 holds the portions 200 and 204 of first and second webs 65 and 66 (FIG. 2) of wrapping material 64 together and retains the selected article 10.

The portions 200 and 204 of first and second webs 65 and 66 (FIGS. 2 and 3) of wrapping material 64 are joined together at a portion 114 of the seal 112 (FIG. 8) located adjacent to the trailing end 110 of the selected article 10. The portion 114 of seal 112 retains the portions 200 and 204 (FIG. 1) of wrapping material 64 in a covering position over the selected article 10.

The portions 200 and 204 of first and second webs 65 and 66 of polymeric wrapping material 64 are further connected at the seal 130 located adjacent to the side edge portion 134 of the selected article 10 and the seal 132 located adjacent to the opposite side edge portion 136 of the selected article 10. The seals 130 and 132 extend along the side edge portions 134 and 136 of the selected article 10 and intersect the portions 80 and 114.

The seals 80, 114, 130 and 132 provide a fluid tight seal for the transparent package containing the selected article 10. Therefore, liquids, dirt and other foreign materials cannot engage the selected article 10.

Apparatus

The first conveyor 30 (FIG. 2) can be any known conveyor for moving the plurality of articles 34 along the supply path 36. The first conveyor 30 includes a plurality of conveyor push bars 230 for moving the plurality of articles 34. The conveyor push bars 230 are positioned along the first conveyor 30 in a spaced relationship to maintain the positional relationship of the plurality of articles 34 and the gap 40 within the stream 32 of articles 34.

Located adjacent to the first conveyor 30 is the deflector 38. The deflector 38 includes an actuator 240 and a deflector arm 242. The actuator 240 pivots the deflector arm 242 into the supply path 36 to deflect the selected article 10. The selected article 10 is deflected from the supply path 32 toward the second conveyor 50 disposed along the wrapping path 52.

Upon deflection of the selected article 10 from the stream 32 of articles 34 moving along the supply path 36, formation of the gap 40 in the stream 32 of articles 34 is initiated. The leading end 100 of the selected article 10 is engaged by the feed section 58 of the second conveyor 50. As the selected article 10 is advanced by the feed section 58, the size of the gap 40 increases (FIG. 4) and the deflector arm 242 pivots back to its initial position (FIG. 5).

The stream 32 of articles 34, including the gap 40, is continuously moved along the supply path 36 as the selected article 10 moves along the wrapping path 52. The movement of the selected article 10 along the wrapping path 52 is continuously at a slightly greater speed than the speed of the stream 32 of articles 34 moving along the supply path 32. The slightly greater speed of the selected article 10 along the wrapping path 52 compensates for the slightly greater distance that the selected article 10 travels along the wrapping path 52.

The slightly greater speed of the selected article 10 along the wrapping path 52 enables the selected article 10 to be moved back into the gap 40 which was created in the stream 32 by the movement of that selected article 10 from the stream 32. Thus, the position of the selected article 10 in the stream 32 before the selected article 10 is removed from the stream 32 is the same as the position of the selected article 10 after the selected article 10 has been wrapped and returned to the stream 32. Therefore, the sequential ordering arrangement of the articles in the stream 32 is maintained.

The first portion of the second conveyor 50 includes the feed section 58 for moving the selected article 10 from the supply path 32 along the wrapping path 52. The feed section 58 includes continuously driven upper belts 250 and lower belts 252. The upper and lower belts 250 and 252 grip and move the selected article 10 along the wrapping path for toward the wrapping station 60.

A guide 256 (FIGS. 2 and 5) is positioned adjacent to the feed section 58 to guide the selected article 10 into the wrapping station 60. The feed section 58 moves the leading end 100 of the selected article 10 into engagement with the guide 256 and then into engagement with the wrapping material 64. The leading end 100 engages the wrapping material 64 at a position located adjacent to the remaining portion 80 of a seal 112 (FIG. 8) formed at the trailing end portion of an immediately preceding selected article.

In the wrapping station 60 (FIG. 2), the wrapping material 64 is tensioned by a first web tensioner 260 and a second web tensioner 268. The first and second web tensioners 260 and 268 remove slack from webs 65 and 66 of wrapping material 64. The two webs 65 and 66 of wrapping material 64 are continuously supplied from feed rolls (not shown).

Figure 6:
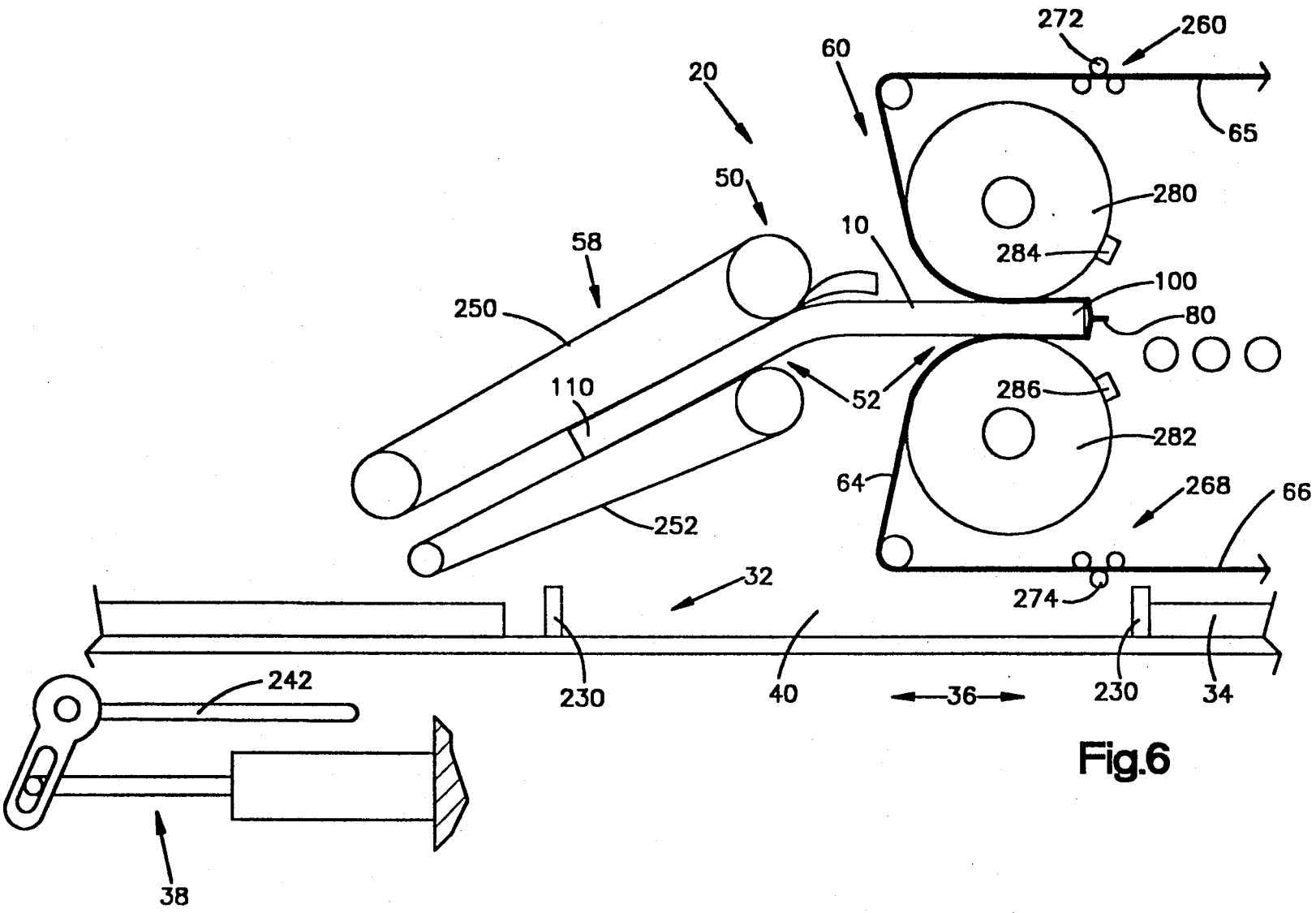
FIG. 6 is a schematic illustration, generally similar to FIG. 5, illustrating the manner in which the selected article and the webs of wrapping material are moved into a nip between a pair of rotary sealer-cutter cylinders.

Movement of the selected article 10 by the feed section 58 moves the leading end 100 of the selected article 10 into engagement with the wrapping material 64 (FIG. 5). The feed section 58 continues to apply force to the selected article 10 to move the selected article 10 and the wrapping material 64 along the wrapping path 52 (FIG. 6). The wrapping material 64 is permitted to move along the wrapping path 52 under the tension provided by the first and second tensioners 260 and 268. The first tensioner 260 permits the wrapping material 64 to move against the biasing force of a movable roller 272. The movable roller 272 moves upwardly when the wrapping material 64 is moved under the forced applied by the leading end 100 of the selected article 10. The second tensioner 268 allows the wrapping material 64 to move in a similar manner with downward movement of a movable roller 274 against a biasing force.

Figure 7:
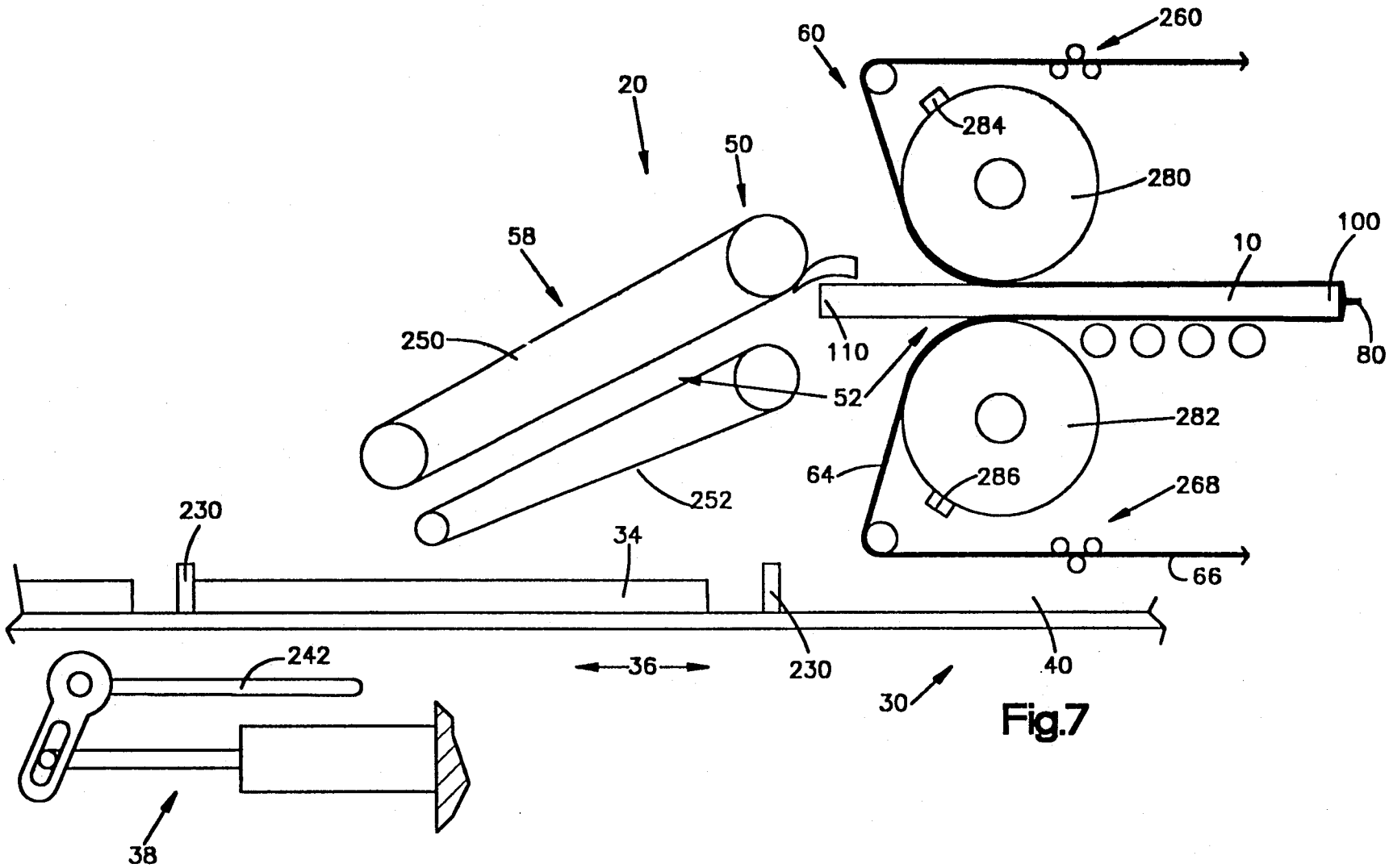
FIG. 7 is a schematic illustration, generally similar to FIGS. 5 and 6, illustrating the manner in which the selected article and the webs of wrapping material move through the nip between the rotary sealer-cutter cylinders.

As the selected article 10 is moved into the wrapping station 60 (FIG. 7), a pair of continuously driven rotary sealer cutters 280 and 282 grip and move the wrapping material 64 and the selected article 10 along the wrapping path 52. The rotary sealer cutter 280 is cylindrical in shape and, as viewed in FIG. 7, is rotated in a counterclockwise direction. The rotary sealer cutter 282 is also cylindrical in shape and, as viewed in FIG. 7, is rotated in a clockwise direction.

The rotary sealer cutters 280 and 282 each have circumferential extents which are greater than the length of the selected article 10. The circumferential extents of the rotary sealer cutters 280 and 282 ar also slightly greater than the spacing between the conveyor push bars 230 disposed on the first conveyor 30. This allows the rotary sealer cutters 280 and 282 to each rotate once for the passage of a conveyor push bar 230 disposed on the adjacent first conveyor 30, and yet provide a slightly greater linear speed to the selected article 10.

Disposed on the rotary sealer cutter 280 is a longitudinally extending sealer cutter element 284 which extends parallel to the central axis of the rotary sealer cutter 280. Disposed on the rotary sealer cutter 282 is a longitudinally extending sealer cutter element 286 which extends parallel to the central axis of the rotary sealer cutter 282. As the trailing end 110 (FIG. 8) of the selected article 10 is moved adjacent to the rotating cylindrical sealer cutters 280 and 282, the sealer cutter elements 284 and 286 moved into simultaneous engagement with the wrapping material 64.

The sealer cutter elements 284 and 286 force the first and second webs 65 and 66 together at a position adjacent to the trailing end 110 of the selected article 10. The sealer cutter elements 284 and 286 apply localized force and heat to form the seal 112 in the wrapping material 64 adjacent the trailing end 110 of the selected article 10. The localized force and heating applied by the sealer cutter elements 284 and 286 then sever the seal 112 longitudinally into first and second portions 80 and 114.

Figure 8:
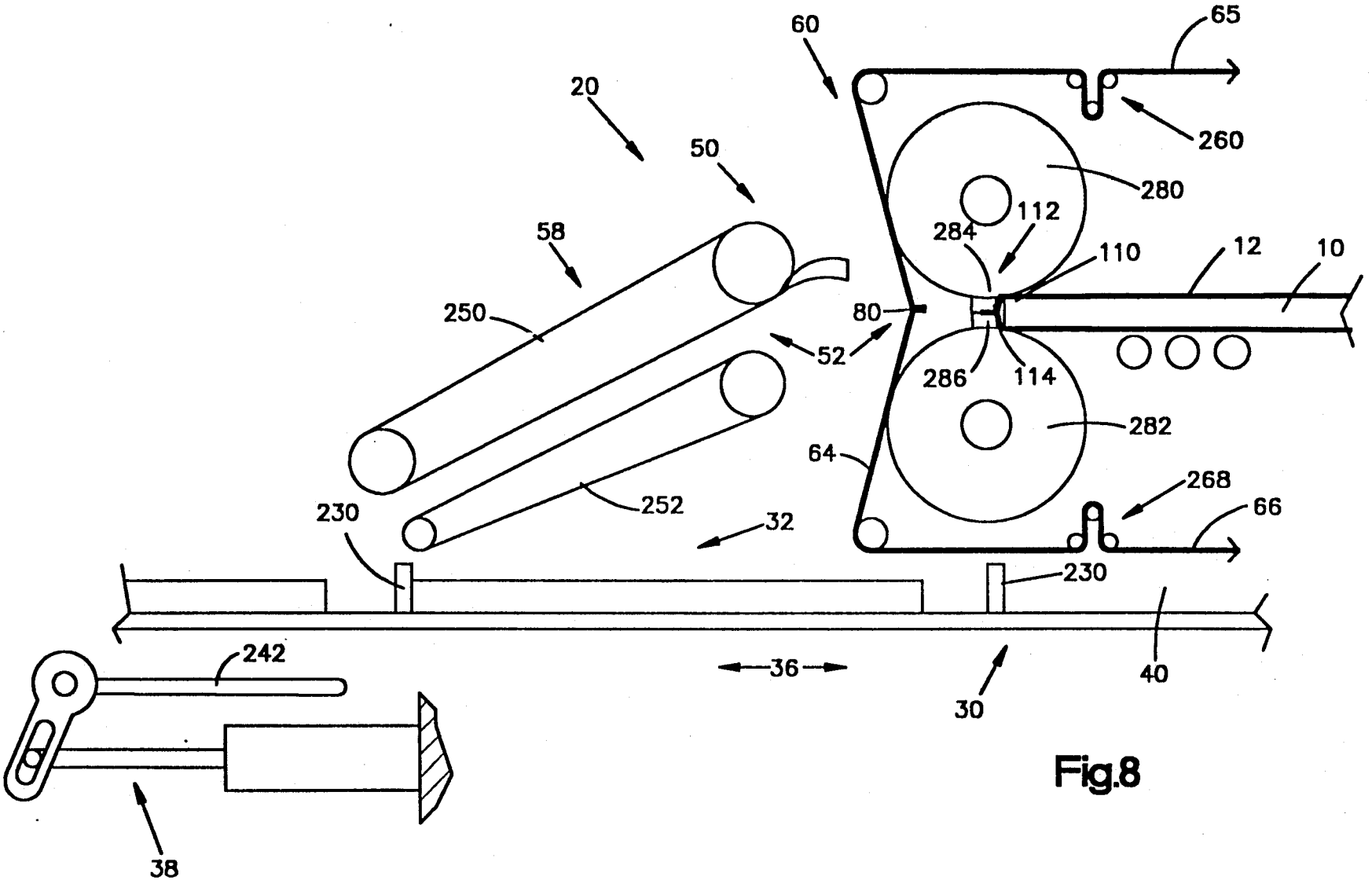
FIG. 8 is a schematic illustration, depicting the manner in which a seal at a trailing end portion of the selected article is severed to leave a portion of the seal interconnecting the webs of wrapping material.

The portion 114 of seal 112 is retained on the portion 12 of wrapping material 64 which covers the selected article 10. The portion 80 of seal 112 is retained on the wrapping material 64 to interconnect the two webs 65 and 66. As shown in FIG. 8, the wrapping material 64 and the attached portion of seal 80 move rearwardly along the wrapping path 52 under the force applied by the first and second tensioners 260 and 268. The first and second tensioners 260 and 268 move the wrapping material 64 to a position adjacent to the feed section 58 to be engaged by a next succeeding selected article 10.

The selected article 10 is moved from the rotary sealer cutters 280 and 282 and into engagement with a pair of continuously driven rotary side sealers 290 and 292 (FIG. 2). The rotary side sealers 290 and 292 are cylindrical in shape. The selected article 10 and the portion of wrapping material 12 are gripped and moved along the wrapping path 52 by the rotary side sealers 290 and 292 (FIG. 9). The rotary side sealer 290, as viewed in FIG. 9, is rotated in a counterclockwise direction. The rotary side sealer 292, as viewed in FIG. 9, is rotated in a clockwise direction.

A pair of circular side sealer elements 294 and 296 are disposed on the periphery of the rotary side sealers 290 and 292. The side sealer elements 294 and 296 are adjacent to the side edge portion 134 (FIG. 1) of the selected article 10 moving along the wrapping path 52 (FIG. 9). The side sealer elements 294 and 296 force the unsealed edges of the portion 12 of wrapping material 64 which covers the selected article 10 together adjacent to the edge 134 of the selected article 10. The side sealer elements 294 and 296 apply localized heat to the portion 12 of wrapping material 64 to form the seal 130 adjacent to the side edge portion 134 of the selected article 10.

Simultaneously, although not shown in FIG. 9, a second pair of circular side sealer elements form the seal 132 in the portion 12 of material 64 which covers the selected article 10 adjacent to the opposite side portions 136 (FIG. 1). A side sealer element 298 of the second pair of side sealer elements disposed on the periphery of the rotary side sealer 290 is shown in FIG. 3. As the selected article 10 is moved along the wrapping path 52 (FIG. 9) by the rotary side sealers 290 and 292, the wrapping of the selected article 10 is completed.

The rotary side sealers 290 and 292 move the wrapped selected article 10 into engagement with the discharge section 90 of the second conveyor 50. A guide 300 is positioned adjacent to the discharge section 90 to insure proper feeding of the wrapped selected article 10 into the discharge section 90. The discharge section 90 includes upper belts 302 (FIG. 10) and lower belts 304 , which are continuously driven. The upper and lower belts 302 and 304 grip and move the wrapped selected article 10 toward the stream 32 of articles 34 moving along the supply path 36.

The wrapped selected article 10 is moved from the wrapping path 52 under the force applied by the discharge section 90 and back into the stream 32 of articles 34 moving along the supply path 36. As the wrapped selected article 10 is moved into the stream 32, a gap 40 is simultaneously moved into position to receive the wrapped select article 10. The gap 40 into which the wrapped selected article 10 is placed is the same gap 40 which was created by the movement of the select article 10 from the stream 32 of articles 34. The wrapped selected article 10 is moved completely onto the supply path 36 (FIG. 11) and back into the stream 32 of articles 36.

Although the preferred embodiment describes the select article 10 and the stream 32 of articles 34 as continuously moving, it would be an obvious variation to stop the selected article 10 and/or the stream 32 of articles 34 at any point along either the wrapping path 52 or the supply path 32. Also, the preferred embodiment describes the wrapping material as being sealed along all of the edges of the article 10, it would be an obvious variation to reduce the amount of seals by folding the wrapping material.

From the above description of the invention, those skilled in the art will perceive improvements, changes and modifications. Such improvements, changes and modifications within the skill of the art are intended to be covered by the appended claims.

Having described the invention, the following is claimed:

1. A method for wrapping selected articles of a plurality of articles, said method comprising the steps of:
   continuously moving a stream of the plurality of articles along a first path;
   sequentially moving selected articles from the stream of articles to a second path which extends through a wrapping station, said step of moving selected articles from the stream of articles includes sequentially forming gaps in the stream of articles at locations where the selected articles are sequentially moved from the stream of articles;
   sequentially moving the selected articles along the second path, and
   wrapping each of the selected articles in turn with wrapping material at the wrapping station,
   said step of sequentially moving selected articles along the second path includes sequentially moving the wrapped articles from the wrapping station along the second path back to the gaps in the stream of articles moving along the first path.

2. A method as set forth in claim 1 wherein said step of wrapping each of the selected articles includes covering a first side portion of each selected article with a first web of wrapping material and covering a second side portion of each selected article, opposite from the first side portion, with a second web of wrapping material to enclose each selected article in turn.

3. A method as set forth in claim 2 wherein said step of sequentially wrapping includes supplying the first and second webs of wrapping material from first and second sources of web material to provide continuous supply of wrapping material.

4. A method as set forth in claim 1 wherein said step of wrapping each of the selected articles includes sealing wrapping material adjacent a trailing edge of one selected article and severing the wrapping material at the seal, said step of severing the wrapping material at the seal includes dividing the seal into first portion which is connected with the wrapping material which wraps the one selected article and second portion which is connected with additional wrapping material.

5. A method as set forth in claim 4 wherein said step of moving the selected articles along the second path includes moving a leading end portion of a second selected article which follows the one selected article into engagement with the additional wrapping material at a location adjacent to the second portion of the seal.

6. A method as set forth in claim 5 further including the step of applying force against the additional wrapping material at the location adjacent to the second portion of the seal with a leading end portion of the second selected article and moving the additional wrapping material under the influence of force applied against the additional wrapping material.

7. A method as set forth in claim 1 wherein said step of wrapping each of the selected articles includes sealing the wrapping material to form seals which are disposed adjacent opposite edge portions of each selected article and extend parallel to the direction of travel of the selected articles along the second path.

8. A method as set forth in claim 7 wherein said step of wrapping each of the selected articles includes sealing the wrapping material to form at least one seal which is disposed adjacent to an end portion of each selected article and which extends transversely to the second path.

9. A method as set forth in claim 1 wherein said step of sequentially moving wrapped articles along the second path back to the gaps in the stream of articles moving along the first path includes moving each one of the selected articles back to a ga formed by performing said step of sequentially moving the one selected article from the first path.

10. A method as set forth in claim 1 wherein said step of sequentially moving selected articles along the second path includes sequentially engaging wrapping material with a leading end portion of each of the selected articles in turn and moving the wrapping material forward along the second path under the influence of force applied against the wrapping material by the leading end portion of a selected article.

11. A method as set forth in claim 1 wherein said step of sequentially moving the selected articles along the second path includes continuously moving each selected article along the second path during the step of sequentially wrapping each selected article.

12. An apparatus as set forth in claim 1, the plurality of articles being a plurality of sheet material magazines.

13. An apparatus for wrapping selected articles of a plurality of articles, said apparatus comprising:

first conveyor means for continuously moving a stream of the plurality of articles along a first path, second conveyor means for sequentially moving selected articles along a second path, deflector means for sequentially moving selected articles from said conveyor means to said second conveyor means, said first conveyor means including means for maintaining a gap in the stream of articles at each location in the stream of articles where a selected article is moved from the stream of articles to said second conveyor means, and wrapping means for sequentially wrapping each selected article with wrapping material at a wrapping station disposed along the second path, said second conveyor means including means for sequentially moving the wrapped articles from the wrapping location along the second path into the gaps in the stream of articles being moved along the first path by the first conveyor means.

14. An apparatus as set forth in claim 13 wherein said wrapping means includes means for covering a first side portion of each selected article with a first web of wrapping material and covering a second side portion of each selected article opposite from the first side with a second web of wrapping material to enclose each selected article in turn.

15. An apparatus as set forth in claim 12 wherein said wrapping means includes means for sealing the wrapping material adjacent a trailing edge of one selected article, and means for severing the wrapping material at a location dividing the seal into a first portion which is connected with the wrapping material which wraps the one selected article and a second portion which is connected with additional wrapping material.

16. An apparatus as set forth in claim 15 wherein said second conveyor means includes means for moving a leading end portion of a second selected article which follows the one selected article into engagement with the additional wrapping material at a location adjacent to the second portion of the seal.

17. An apparatus as set forth in claim 16 wherein said second conveyor means includes means for applying force to the second selected article to press the leading end portion of the second selected article against the additional wrapping material to move the additional wrapping material under the influence of the force.

18. An apparatus as set forth in claim 13 wherein said wrapping means includes means for sealing the wrapping material to form seals which are disposed adjacent opposite edge portions of each selected article and extend parallel to the direction of travel of the selected article along the second path.

19. An apparatus as set forth in claim 18 wherein said wrapping means includes means for sealing the wrapping material to form at least one seal for each selected article, said one seal being disposed adjacent to an end portion a selected article and extending perpendicular to the direction of travel of the selected article along the second path.

20. An apparatus as set forth in claim 13 wherein said second conveyor means includes means for sequentially moving each one of the wrapped articles back to a gap maintained in the stream of articles that was formed by sequentially moving the one article from the stream of articles.

21. An apparatus as set forth in claim 13 wherein said second conveyor means includes means for sequentially moving each of the selected articles forwardly to engage the wrapping material with a leading end portion of each of the selected articles in turn and mean for sequentially moving each of the selected articles forward after engaging the wrapping material to move the wrapping material forward under the influence of force applied to the wrapping material by the leading end portion of each of the selected articles in turn.

22. An apparatus as set forth in claim 13 wherein the second conveyor means includes means for continuously moving each selected articles along the second path during the step of sequentially wrapping each selected article.

23. An apparatus as set forth in claim 14 including means for supplying the first and second webs of wrapping material from first and second sources of web material to provide a continuous supply of material.

24. An apparatus for wrapping a plurality of articles, said apparatus comprising:

conveyor means for sequentially moving the plurality of articles along a first path, wrapping means for sequentially wrapping the plurality of articles with wrapping material, and means for continuously moving a stream of articles along a supply path, said wrapping means including means for sealing wrapping material to provide a first seal adjacent a trailing end of a first article of the plurality of articles and means for severing the wrapping material at the first seal to divide the first seal into a first portion which is connected with the wrapping material which wraps the first article and a second portion which is connected with additional wrapping material, said conveyor means including means for moving a leading edge portion of a second article of the plurality of articles into engagement with the additional wrapping material adjacent to the second portion of the seal and means for applying force against the additional wrapping material with the leading end portion of the second article to move the additional wrapping material along the first path, said conveyor means including means for moving wrapped articles along a portion of the first path into gaps in the stream of articles moving along the supply path.

25. An apparatus as set forth in claim 24 further including deflector means for sequentially moving selected articles from said stream of articles to the first path to provide the plurality of articles sequentially moving along the first path and to form the gaps in the stream of articles moving along the supply path. said means for continuously moving a stream of articles along a supply path includes means for maintaining the gaps in the stream of articles where selected articles are moved from the stream of articles to the first path.

26. An apparatus as set forth in claim 25 wherein said conveyor means includes means for sequentially moving each one of the wrapped articles back to a gap maintained in the stream of articles that was formed by sequentially moving the one article from the stream of articles.

27. A method for wrapping a plurality of articles, said method comprising the steps of:

sequentially moving the plurality of articles along a first path, sequentially wrapping the plurality of articles with wrapping material.

continuously moving a stream of articles along a second path. and sequentially moving selected articles from the second path to the first path to provide the plurality of articles sequentially moving along the first path, said step of sequentially wrapping the plurality of articles including forming a first seal in the wrapping material adjacent to a first article of the plurality of articles and severing the wrapping material at the first seal to divide the first seal into a first portion which is connected with the wrapping material which wraps the first article and a second portion which is connected with additional wrapping material, said step of sequentially moving the plurality of articles along a first path including moving a leading end portion of a second article of the plurality of articles into engagement with the additional wrapping material adjacent to the second portion of the seal and applying force against the additional wrapping material with the leading end portion of the second article to move the additional wrapping material along the first path, said step of sequentially moving selected articles from the second path including sequentially forming gaps in the stream of articles moving along the second path at locations in the stream where the selected articles are sequentially moved from the second path.

28. A method as set forth in claim 27 wherein said step of sequentially moving the plurality of articles along the first path includes sequentially moving wrapped articles along a portion of the first path back to the gaps in the stream of articles moving along the second path.

29. A method as set forth in claim 28 wherein said step of sequentially moving wrapped articles along a portion of the first path back to the gaps in the stream of articles moving along the second path includes moving each one of the selected articles back to a gap formed by performing said step of sequentially moving the one selected article from the second path.

30. A method for wrapping a plurality of articles, said method comprising the steps of:

sequentially moving the plurality of articles along a first path, and sequentially wrapping the plurality of articles with wrapping material, said step of sequentially wrapping the plurality of articles including forming a first seal in the wrapping material adjacent to a first article of the plurality of articles and severing the wrapping material at the first seal to divide the first seal into a first portion which is connected with the wrapping material which wraps the first article and a second portion which is connected with additional wrapping material, said step of sequentially moving the plurality of articles along a first path including moving a leading end portion of a second article of the plurality of articles into engagement with the additional wrapping material adjacent to the second portion of the seal and applying force against the additional wrapping material with the leading end portion of the second article to move the additional wrapping material along the first path, said step of sequentially moving the plurality of articles along a first path including sequentially moving wrapped articles along a portion of the first path into gaps in a stream of articles moving along a second path.

31. A method as set forth in claim 30 further including the steps of continuously moving the stream of articles moving along the second path, and sequentially moving selected articles from the second path to the first path, said step of sequentially moving selected articles from the second path includes sequentially forming the gaps in the stream of articles moving along the second path at locations in the stream where the selected articles are sequentially moved from the second path.

32. A method as set forth in claim 31 wherein said step of sequentially moving wrapped articles along a portion of the first path into gaps in a stream of articles moving along a second path includes moving each one of the selected articles into a gap in the stream of articles formed by performing said step of sequentially moving a selected article from the stream of articles moving along the second path to the first path.

33. A method for wrapping a plurality of sheet material articles, said method comprising the steps of:

sequentially moving the plurality of sheet material articles along a first path, and sequentially wrapping the plurality of sheet material articles with wrapping material, said step of sequentially wrapping the plurality of sheet material articles including forming a first seal in the wrapping material adjacent to a first sheet material article of the plurality of sheet material articles and severing the wrapping material at the first seal to divide the first seal into a first portion which is connected with the wrapping material which wraps the first sheet material article and a second portion which is connected with additional wrapping material, said step of sequentially wrapping the plurality of sheet material articles including forming in the wrapping material second and third seals which are disposed adjacent opposite edge portions of each selected sheet material article, the second and third seals extending parallel to the direction of travel of the plurality of sheet material articles along the first path, the second and third seals intersecting the first portion of the first seal, said step of sequentially moving the plurality of sheet material articles along a first path including moving a leading end portion of a second sheet material article of the plurality of sheet material articles into engagement with the additional wrapping material adjacent to the second portion of the seal and applying force against the additional wrapping material with a leading end portion of the second sheet material article to move the additional wrapping material along the first path.

34. A method as set forth in claim 33 wherein said step of sequentially wrapping the plurality of sheet material articles includes covering an upper side portion of each sheet material article of the plurality of sheet material articles with a first web of wrapping material and covering a lower side portion of each sheet material article of the plurality of sheet material articles with a second web of wrapping material to enclose each of the plurality of sheet material articles.

35. A method as set forth in claim 34 wherein the step of sequentially wrapping includes supplying the first and second webs of wrapping materials from first and second sources of web material to provide continuous supply of material.

36. A method as set forth in claim 33 wherein the step of sequentially moving the plurality of sheet material articles along a first path includes continuously moving at least one of the plurality of sheet material articles along the first path during the step of sequentially wrapping the one of the plurality of sheet material articles.

37. An apparatus for wrapping a plurality of articles, said apparatus comprising:

conveyor means for sequentially moving the plurality of articles along a first path, wrapping means for sequentially wrapping the plurality of articles with wrapping material, means for continuously moving a stream of articles along a supply path, and deflector means for sequentially moving selected articles from said supply path to said conveyor means, said wrapping means including means for sealing wrapping material to provide a first seal adjacent a trailing end of a first article of the plurality of articles and means for severing the wrapping material at the first seal to divide the first seal into a first portion which is connected with the wrapping material which wraps the first article and a second portion which is connected with additional wrapping material, said conveyor means including means for moving a leading edge portion of a second article of the plurality of articles into engagement with the additional wrapping material adjacent to the second portion of the seal and means for applying force against the additional wrapping material with the leading end portion of the second article to move the additional wrapping material along the first path, said means for continuously moving a stream of articles along a supply path including means for maintaining a gap in the stream of articles where a selected article is moved from the stream of articles to said conveyor means.

38. An apparatus as set forth in claim 37 wherein said conveyor means includes means for sequentially moving wrapped articles along a portion of the first path back to the gaps in the stream of articles.

39. An apparatus as set forth in claim 38 wherein said conveyor means includes means for sequentially moving each one of the wrapped articles back to a gap maintained in the stream of articles that was formed by sequentially moving the one article from the stream of articles.

40. An apparatus for wrapping a plurality of articles, said apparatus comprising:

conveyor means for sequentially moving the plurality of articles along a first path, and wrapping means for sequentially wrapping the plurality of articles with wrapping material, said wrapping means including means for sealing wrapping material to provide a first seal adjacent a trailing end of a first article of the plurality of articles and means for severing the wrapping material at the first seal to divide the first seal into a first portion which is connected with the wrapping material which wraps the first article and a second portion which is connected with additional wrapping material, said conveyor means including means for moving a leading edge portion of a second article of the plurality of articles into engagement with the additional wrapping material adjacent to the second portion of the seal and means for applying force against the additional wrapping material with the leading end portion of the second article to move the additional wrapping material along the first path, said conveyor means including a pair of rotary members for gripping and moving the wrapping material and the first article of the plurality of articles, said means for sealing and said means for severing including a pair of sealer cutter elements disposed on said pair of rotary members.

41. An apparatus as set forth in claim 40 wherein said wrapping means includes means for covering a first side portion of each article of the plurality of articles with a first web of wrapping material an covering a second side portion of each article of the plurality of articles with a second web of wrapping material to enclose each of the plurality of articles.

42. A method as set forth in claim 41 wherein said wrapping means includes means for supplying the first and second webs of wrapping material from first and second sources of web material to provide continuous supply of material.

43. An apparatus as set forth in claim 40 wherein the wrapping means includes means for sealing the wrapping material to form seals which are disposed adjacent opposite edge portions of each of the plurality of articles and extend parallel to the direction of travel of the plurality of articles along the first path.

44. An apparatus as set forth in claim 40 wherein said conveyor means includes means for continuously moving at least one of the plurality of articles along the first path during the step of sequentially wrapping the one of the plurality of articles.

* * * * *

UNITED STATES PATENT AND TRADEMARK OFFICE

CERTIFICATE OF CORRECTION

PATENT NO. : 5,113,639

DATED : May 19, 1992

INVENTOR(S) : Robert A. Bryson

It is certified that error appears in the above-identified patent and that said Letters Patent is hereby corrected as shown below:

Column 9, Line 19, Claim 9, change "ga" to --gap--.

Column 9, Line 66, Claim 15, change "12" to --13--.

Column 10, Line 41, Claim 21, change "mean" to --means--.

Column 14, Line 62, Claim 42, change "a method" to --an apparatus--.

Signed and Sealed this

Thirty-first Day of August, 1993

Bruce Lehman

*Attest:*

BRUCE LEHMAN

*Attesting Officer*

*Commissioner of Patents and Trademarks*